US010661520B2

(12) United States Patent
Cui et al.

(10) Patent No.: US 10,661,520 B2
(45) Date of Patent: May 26, 2020

(54) PRESSING ASSEMBLY

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Jian Cui, Shenzhen (CN); Long-Fong Chen, New Taipei (TW)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 292 days.

(21) Appl. No.: 15/600,772

(22) Filed: May 21, 2017

(65) Prior Publication Data

US 2017/0341329 A1 Nov. 30, 2017

(30) Foreign Application Priority Data

May 27, 2016 (CN) ..... 2016 1 0360018

(51) Int. Cl.
*B30B 15/00* (2006.01)
*B30B 1/00* (2006.01)

(52) U.S. Cl.
CPC ..... *B30B 15/0029* (2013.01); *B30B 1/00* (2013.01)

(58) Field of Classification Search
CPC ..... B30B 1/00; B30B 15/0029
USPC ..... 100/265, 266
See application file for complete search history.

(56) References Cited

U.S. PATENT DOCUMENTS 1,552,228 A * 9/1925 Isaac ..... B30B 15/0064 100/265
2,422,097 A * 6/1947 Hansen ..... H01H 13/585 200/16 A
3,301,977 A * 1/1967 Simonin, Jr. ..... H01H 35/2607 200/82 R
3,937,912 A * 2/1976 Martin ..... H01H 35/38 200/82 C
4,282,476 A * 8/1981 Frezzolini ..... H02J 7/009 200/83 J
4,388,505 A * 6/1983 Sarian ..... H01H 35/32 200/83 C
4,411,154 A * 10/1983 Kitamura ..... F02D 11/106 73/114.36
5,063,276 A * 11/1991 Woodard ..... H01H 1/18 200/241

(Continued)

FOREIGN PATENT DOCUMENTS

CN 103794387 A 5/2014
CN 105185612 A 12/2015

*Primary Examiner* — Teresa M Ekiert
*Assistant Examiner* — Jared O Brown
(74) *Attorney, Agent, or Firm* — ScienBiziP, P.C.

(57) ABSTRACT

A pressing assembly includes a button, a first connection portion, a receiving portion, a first elastic element, a pressing rod, and a pressing portion. The first connection portion includes a first end movably connected to the button and a second end connected to the receiving portion. The receiving portion defines a receiving space. A part of the pressing rod is movably received in the receiving space. The first elastic element is received in the receiving space. One end of the first elastic element is fixed, another end of the first elastic element resists the pressing rod. The pressing portion is connected to the pressing rod.

9 Claims, 3 Drawing Sheets

(56) References Cited

U.S. PATENT DOCUMENTS

| | | | | |
|---|---|---|---|---|
| 5,359,163 | A * | 10/1994 | Woodard | H01H 3/32 200/249 |
| 7,325,491 | B2 * | 2/2008 | Petiziol | A47J 31/44 100/219 |
| 9,466,909 | B1 * | 10/2016 | Lin | H01R 13/2421 |
| 2004/0206243 | A1 * | 10/2004 | Foster | A47J 31/44 99/279 |
| 2014/0018665 | A1 * | 1/2014 | Meredith | A61M 25/0127 600/417 |

* cited by examiner

PRESSING ASSEMBLY

CROSS-REFERENCE TO RELATED APPLICATIONS

This application claims priority to Chinese Patent Application No. 201610360018.1 filed on May 27, 2016.

FIELD

The subject matter herein generally relates to pressing assemblies, and particularly to a pressing assembly capable of adjusting a value of a pressing force applied to target object.

BACKGROUND

Pressing assemblies are widely used. The precision of a pressing value applied manually to a target object may be difficult to achieve.

BRIEF DESCRIPTION OF THE DRAWINGS

Implementations of the present technology will now be described, by way of example only, with reference to the attached figures.

DETAILED DESCRIPTION

Figure 1:
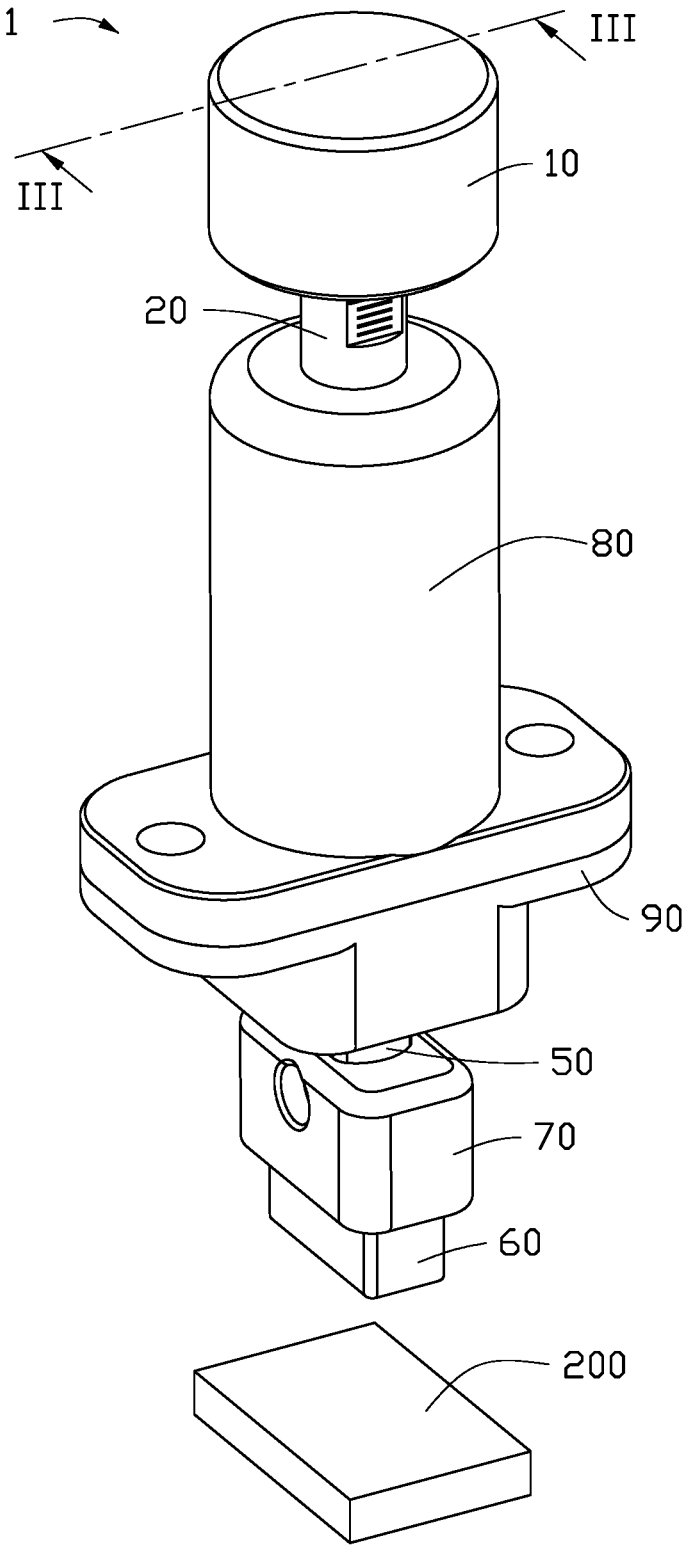
FIG. 1 is a schematic diagram illustrating an exemplary embodiment of a pressing assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to", it specifically indicates open-ended inclusion or membership in a so-described combination, group, series, and the like.

Figure 2:
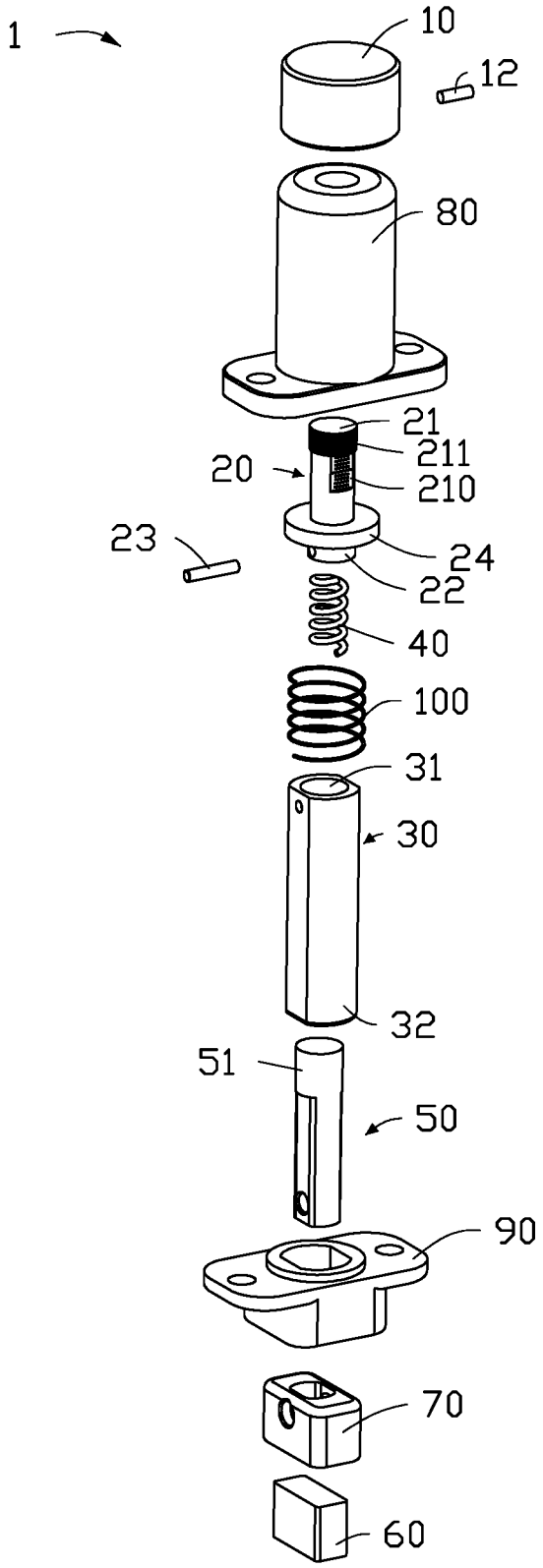
FIG. 2 is an exploded view of the pressing assembly of FIG. 1.

FIG. 1 and FIG. 2 illustrate an exemplary embodiment of a pressing assembly 1. In the exemplary embodiment, the pressing assembly 1 can include, but is not limited to, a button 10, a first connecting portion 20, a receiving portion 30, a first elastic element 40, a pressing rod 50, and a pressing portion 60.

Referring to FIG. 2, in the exemplary embodiment, the button 10 is a hollow cylinder, a threaded hole 11 (see FIG. 3) is defined inside of the button 10. The first connecting portion 20 is cylindrical, the first connecting portion 20 can include a first end 21 and a second end 22. The first end 21 defines a threaded portion 211 corresponding to the threaded hole 11. The first end 21 is movably connected to the button 10 by screwing the threaded portion 211 into the threaded hole 11. The threaded portion 211 can be screwed in or screwed out of the through hole 11 by rotating the button 10 clockwise or anticlockwise. The second end 22 is received in the receiving portion 30. A scale line 210 is defined on an outer surface of the first end 21. An exposure length of the scale line 210 can be adjusted by rotating the button 10. Herein, the exposure length of the scale line 210 equals a maximum distance that the button can be pressed, the maximum travelling distance of the button 10 can be adjusted by rotating the button 10.

The second end 22 resists one end of the first elastic element 40. In the embodiment, the first elastic element 40 is a spring. The receiving portion 30 defines a receiving space 31, the first elastic element 40 is received in the receiving space 31. A part of the pressing rod 50 is movably received in the receiving space 31 and resists another end of the first elastic element 40. The first elastic element 40 is connected between the first connecting portion 20 and the pressing rod 50. In the exemplary embodiment, a diameter of the first elastic element 40 is less than the diameter of the pressing rod 50 and the diameter of the first connecting portion 20. A starting state of the first elastic element 40 is compressed. When using the pressing assembly 1 to press a target object 200, a value of the pressing force can be adjusted by adjusting a compression (that is to say, the length) of the first elastic element 40.

In the exemplary embodiment, the receiving portion 30 further includes an end portion 32 which is away from the first connecting portion 20. An inner diameter of the end portion 32 is less than the inner diameter of other parts of the receiving portion 30. The pressing rod 50 further includes a latching portion 51, the latching portion 51 is blocked by the end portion 32 to prevent the pressing rod 50 from coming out from the receiving portion 30.

The pressing portion 60 is connected to an end of the pressing rod 50 which is away from the first elastic element 40. In the exemplary embodiment, the pressing assembly 1 further includes a second connecting portion 70. The pressing portion 60 is connected to the pressing rod 50 via the second connecting portion 70.

Figure 3:
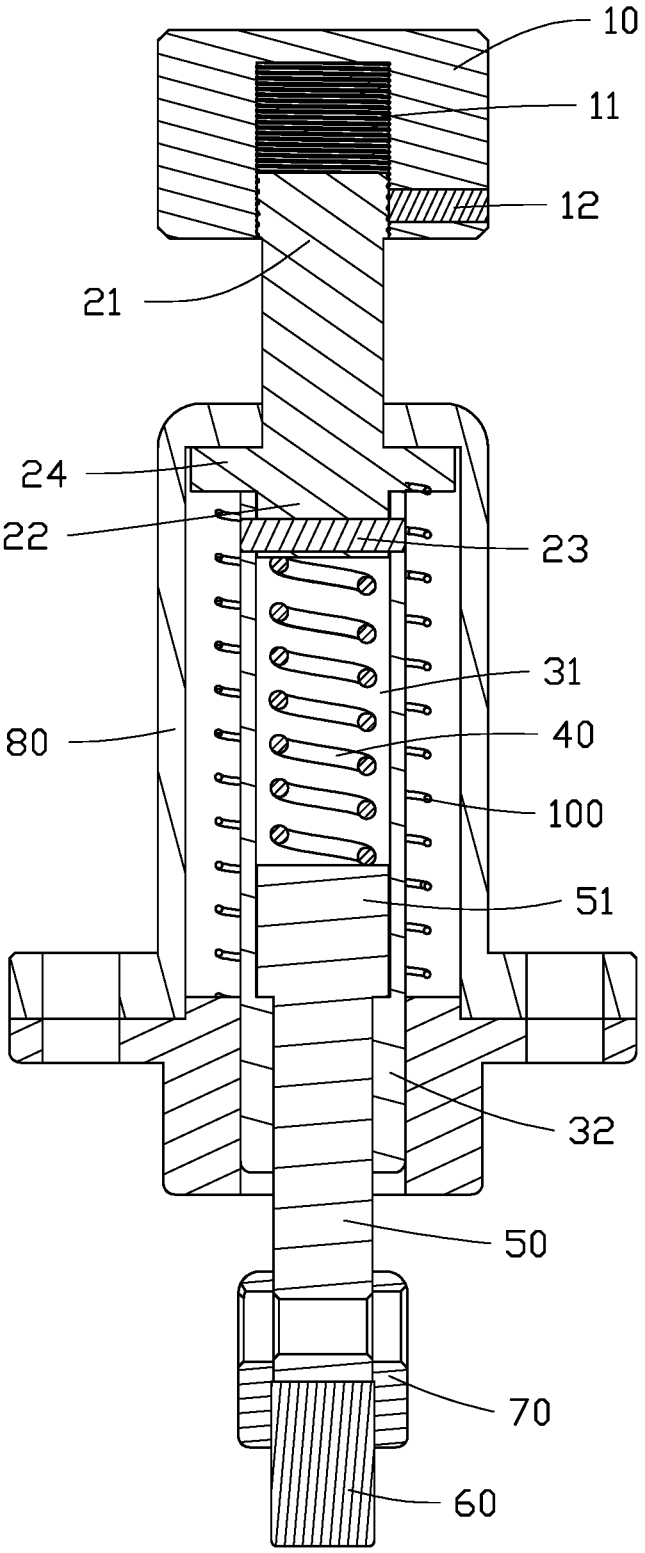
FIG. 3 is a sectional view of the pressing assembly of FIG. 1.

Referring to FIG. 2 and FIG. 3, the pressing assembly 1 further includes a first fixing member 12 to fix the threaded portion 111 in the threaded hole 11. In the exemplary embodiment, the first fixing member 12 can be a screw which passes through a sidewall of the button 10, one end of the first fixing member 12 resists the threaded portion 111, another end of the first fixing member 12 is exposed for a user to operate.

In the exemplary embodiment, the pressing assembly 1 further includes a second fixing member 23. Both of the receiving portion 30 and the second end 22 of the first connecting portion 20 define a through hole (not shown), the second fixing member 23 passes through the through hole of the second end 22 and the receiving portion 30 to fix the second end 22 of the first connecting portion 20 to the receiving portion 30. In the exemplary embodiment, the second fixing member 23 is a dowel.

In the exemplary embodiment, the pressing assembly 1 further includes a shell 80 and a third fixing member 90. The first connecting portion 20 further includes a resisting portion 24. The shell 80 is a hollow cylinder open at both ends. One end of the shell 80 is around the first end 21 of the first connecting portion 20 and resists the resisting portion 24. Another end of the shell 80 is fixed to the third fixing member 90. The receiving portion 30 is received in the shell 80, the pressing rod 50 passes through the third fixing member 90 to connect to the pressing portion 60.

In the exemplary embodiment, the pressing assembly 1 further includes a second elastic element 100 coiled around the receiving portion 30. One end of the second elastic element 100 resists the resisting portion 24, another end of the second elastic element 100 resists the third fixing member 90. In the exemplary embodiment, the second elastic element 100 is a spring for resetting.

Referring to FIG. 3, when using the pressing assembly 1 to press the target object 200, a user can first align the pressing portion 60 to the target object 200 then press the button 10 to drive the pressing portion 60 to move toward the target object 200 until the pressing portion 60 presses on the target object 200. When the pressing portion 60 applies a pressing force to the target object 200, the first connecting portion 20 and the pressing rod 50 compress the first elastic element 40. In the exemplary embodiment, a value of the pressing force applied to the target object 200 equals the power of compression that the first connecting portion 20 and the pressing rod 50 apply to the first elastic element 40. Therefore, the pressing force applied to the target object 200 can be adjusted by adjusting a compressing distance of the first elastic element 40. In the exemplary embodiment, the compressing distance of the first elastic element 40 $S=L-(D1+D2)$, where L is a maximum travel distance of the button 10 being pressed, D1 is an original distance between the pressing portion 60 and the target object 200, and D2 is an original length of the first elastic element 40. The value of the pressing force $F=K*S$, K being an elastic coefficient of the first elastic element 40.

When the pressing assembly 1 is pressing the target object 200, the second elastic element 100 is compressed by the resisting portion 24 of the first connecting portion 20. When the pressing assembly 1 is released by the user, an elastic restoring force of the second elastic element 100 drives the first connecting portion 20 to move back to an initial position.

In the exemplary embodiment, a size of the pressing assembly 1 can be adjusted as needed. For example, the pressing assembly 1 can be used as a pressing device independently. The pressing assembly 1 further can be used in manufacturing by a factory. The pressing assembly 1 also can be used in push switches of electronic devices.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A pressing assembly comprising:

a button;

a first connecting portion comprising a first end and a second end, the first end being movably connected to the button, wherein a scale line is defined on an outer surface of the first end of the first connecting portion;

a receiving portion connected to the second end of the first connecting portion, the receiving portion defining a receiving space;

a first elastic element received in the receiving space, one end of the first elastic element resisting the second end of the first connecting portion:

a pressing rod partly received in the receiving space, another end of the first elastic element resisting the pressing rod;

a pressing portion connected to the pressing rod; and the pressing portion applies a pressing force to a target object, the first connecting portion and the pressing rod compress the first elastic element, the pressing force applied to the target object is calculated by a first formula: $F=K*S$, K is an elastic coefficient of the first elastic element, S is a compressing distance of the first elastic element; wherein the compressing distance is calculated by a second formula: $S=L-(D1+D2)$, L is a maximum travel distance of the button being pressed and the maximum travel distance is equal to an exposure length of the scale line, D1 is an original distance between the pressing portion and the target object, and D2 is an original length of the first elastic element.

2. The pressing assembly of claim 1, wherein the pressing assembly further comprises a second connecting portion, the pressing portion is connected to the pressing rod via the second connecting portion.

3. The pressing assembly of claim 1, wherein the button is a hollow cylinder, a threaded hole is defined inside of the button; a threaded portion is defined on the first end of the first connecting portion, the first end is movably connected to the button by screwing the threaded portion into the threaded hole.

4. The pressing assembly of claim 3, comprising a first fixing member, wherein the first fixing member passes through a sidewall of the button, one end of the fixing member resists the threaded portion to fix the threaded portion.

5. The pressing assembly of claim 4, further comprising a second fixing member, wherein the second fixing member passes through the receiving portion and the second end to fix the second end to the receiving portion.

6. The pressing assembly of claim 1, wherein the receiving portion further comprises an end portion away from the first connecting portion, an inner diameter of the end portion is less than the inner diameter of other parts of the receiving portion, the pressing rod comprises a latching portion, the latching portion is blocked by the end portion to prevent the pressing rod from coming out from the receiving portion.

7. The pressing assembly of claim 5, further comprising a shell and a third fixing member, the first connecting portion further comprising a resisting portion, wherein the shell is a hollow cylinder open at both ends, one end of the shell is around the first end of the first connecting portion and resists the resisting portion, another end of the shell is fixed to the third fixing member; the receiving portion is received in the shell, the pressing rod passes through the third fixing member to connect to the pressing portion.

8. The pressing assembly of claim 7, further comprising a second elastic element coiled around the receiving portion, wherein one end of the second elastic element resists the resisting portion, another end of the second elastic element resists the third fixing member.

9. The pressing assembly of claim 8, wherein the second elastic element is a reset spring.

* * * * *